US008768000B2

(12) United States Patent
Chen et al.

(10) Patent No.: US 8,768,000 B2
(45) Date of Patent: Jul. 1, 2014

(54) STRUCTURE FOR AMPLIFIER

(75) Inventors: Cheng-Yuan Chen, New Taipei (TW); Hong-Bing Tsai, Yilan (TW)

(73) Assignee: Global Target Enterprise Inc., New Taipei (TW)

( * ) Notice: Subject to any disclaimer, the term of this patent is extended or adjusted under 35 U.S.C. 154(b) by 409 days.

(21) Appl. No.: 13/088,530

(22) Filed: Apr. 18, 2011

(65) Prior Publication Data

US 2012/0183157 A1 Jul. 19, 2012

(30) Foreign Application Priority Data

Jan. 19, 2011 (TW) ..... 100101902 A

(51) Int. Cl.
*H04R 1/00* (2006.01)
*H04R 1/02* (2006.01)

(52) U.S. Cl.
USPC ..... 381/403; 381/404; 381/396

(58) Field of Classification Search
USPC ..... 381/347, 404, 418; 181/166, 171, 172
See application file for complete search history.

(56) References Cited

U.S. PATENT DOCUMENTS 5,999,633 A * 12/1999 Imai ..... 381/403
7,076,079 B2 * 7/2006 Chung ..... 381/404
7,840,025 B2 * 11/2010 Ikeda et al. ..... 381/404

* cited by examiner

*Primary Examiner* — Vivian Chin
*Assistant Examiner* — Ammar Hamid
(74) *Attorney, Agent, or Firm* — Ming Chow; Sinorica, LLC

(57) ABSTRACT

An improved structure for an amplifier comprises: a single member, which at least has a frame, an edge and a membrane; and a positioning shrapnel, which is assembled by an inner frame, an outer frame and a plurality of flexible braces, the outer frame is firmly disposed at the frame of the single member, the plurality of flexible braces is disposed between the inner frame and the outer frame, the inner frame is firmly disposed on the membrane of the single member, wherein the peripheral of the frame has a fillister that can be embedded in by the outer frame, each connection of any of the flexible braces and the inner frame is a curve portion that is to keep the connection of the inner frame and the outer frame while a height difference is existed between the inner frame and the outer frame.

13 Claims, 16 Drawing Sheets

STRUCTURE FOR AMPLIFIER

BACKGROUND OF THE INVENTION

1. Field of the Invention

The present invention generally relates to an improved structure for an amplifier, more particularly to an improved structure that is to firmly dispose a positioning shrapnel on a sound-emitting surface of a single member of the amplifier, wherein the positioning shrapnel can effectively position and balance the vibration state of a membrane.

2. Description of the Prior Art

Prior amplifier structure is an electronic device that is to transfer electronic signals to sound signals. Voice coils and magnetic members are mutually exclusive after the voice coils are electrified, a motion similar to piston is thus activated so as to push a membrane in front of the magnetic members, and sound waves in front of the membrane are radiated outwardly. Circular wave structure in the amplifier structure is to position the voice coils and disposed between the magnetic members and the membrane, the volume is hardly reduced. Based on the restriction, electronic products with slime volumes can not be applied as well.

Scientific electronic products as slim TV, laptop computer, tablet PC, PDA, MP3 player, cellular phone, etc. are designed to approach the purposes of slim and easy-to-carry, thus the dimensions of the whole volume of each of the aforesaid scientific electronic products shall be very small, so that a room for accommodating an amplifier for each product is very limited. Accordingly, some types of planar amplifiers are generated. To determine small size for such planar amplifier, the circular wave structure shall be eliminated. Distortion may not happen while in low power output since the amplitude of the membrane is small; otherwise, unbalanced vibration and shake may be generated while in high power output since the amplitude is large. Continuously the output sound/voice shall be very unstable. Therefore, obviously the prior planar amplifier can be applied to low power output, but not for high power output.

As a conclusion, to submit an improved structure for an amplifier to replace the circular wave structure or effectively position and balance the vibration state of the membrane while in high power output in order to steadily output sound/voice is an important issue to the skilled people.

SUMMARY OF THE INVENTION

The main objective of the present invention is to provide an improved structure for an amplifier, a positioning shrapnel is firmly disposed on a sound-emitting surface of a single member of the amplifier, the positioning shrapnel can position and balance the vibration state of a membrane, so that the unbalanced vibration from the membrane and a situation of unstable frequencies can be avoided when the improved structure is in a condition of high power.

The second objective of the present invention is to provide the improved structure for the amplifier, which not only provides a slim volume, but also high power output, hence the amplifier can be versatile in the aspect of application.

The third objective of the present invention is to provide the improved structure for the amplifier, wherein the positioning shrapnel is suitable to different types of single members of amplifiers, therefore, the formation, quantity and bending angle of the flexible brace can be adjusted in order to approach the best output.

An improved structure for an amplifier comprises: a single member 11, which at least has a frame 111, an edge 112 and a membrane 113; and a positioning shrapnel 12, which is assembled by an inner frame 121, an outer frame 122 and a plurality of flexible braces 123, the outer frame 122 is firmly disposed at the frame 111 of the single member 11, the plurality of flexible braces 123 is disposed between the inner frame 121 and the outer frame 122, the inner frame 121 is firmly disposed on the membrane 113 of the single member 11, wherein the peripheral of the frame 111 has a fillister 1111 that can be embedded in by the outer frame 122, each connection of any of the flexible braces 123 and the inner frame 121 is a curve portion 1231 that is to keep the connection of the inner frame 121 and the outer frame 122 while a height difference is existed between the inner frame 121 and the outer frame 122, any of the flexible braces 123 is curved to be disposed between the inner frame 121 and the outer frame 122, and the inner frame 121 is a planar member.

An improved structure for an amplifier comprises: a single member 21, which at least has a frame 211, an edge 212 and a membrane 213; and a positioning shrapnel 22, which is assembled by an outer frame 222 and a plurality of flexible braces 223, the outer frame 222 is firmly disposed at the frame 211 of the single member 21, the one end 2231 of each of the plurality of flexible braces 223 are connected with the outer frame 222, the other end 2232 of each of the plurality of flexible braces 223 is firmly disposed on the membrane 213, wherein the one end of each of the plurality of flexible braces 223 is connected with the outer frame 222, the other end of each of the plurality of flexible braces 223 being a holding portion 2232 that is firmly disposed on the membrane 213, the peripheral of the frame 211 has a fillister 2111 that can be embedded in by the outer frame 222, and each of the flexible braces 223 has a curve portion 2231 that is to keep the connection of the holding portion 2232 and the outer frame 222 while a height difference is existed between the holding portion 2232 and the outer frame 222.

An improved structure for an amplifier comprises: a single member 31, which at least has a frame 311, an edge 312 and a membrane 313; and a positioning shrapnel 32, which is assembled by an outer frame 322 and a plurality of flexible braces 323 that are extended from the outer frame 322 individually, the outer frame 222 is firmly disposed at the frame 311 of the single member 31, the one end of each of the plurality of flexible braces 323 is connected with the outer frame 322, the other end of each of the plurality of flexible braces 223 is firmly disposed on the membrane 313, wherein the peripheral of the frame 311 has a fillister 3111 that can be embedded in by the outer frame 322, and any of the flexible braces 323 is curved and disposed.

An improved structure for an amplifier comprises: a single member 61, which at least has a frame 611, an edge 612, a membrane 613, a voice coil 615, and an anti-dust cover 614; and a positioning shrapnel 62, which is assembled by an inner frame 621, an outer frame 622 and a plurality of flexible braces 623, the outer frame 622 is firmly disposed at the frame 611 of the single member 61, the flexible braces 623 are disposed between the inner frame 621 and the outer frame 622, the inner frame 621 is firmly disposed on the anti-dust cover 614 of the single member 61, wherein the inner frame 621 is firmly disposed between the anti-dust cover 614 and the voice coil 615 of the single member 61, the peripheral of the frame 611 has a fillister 6111 that can be embedded in by the outer frame 622, each connection of any of the flexible braces 623 and the inner frame 621 is a curve portion 6231 that is to keep the connection of the inner frame 621 and the outer frame 622 while a height difference is existed between the inner frame 621 and the outer frame 622, any of the flexible braces 623 is curved to be disposed between the inner frame 621 and the outer frame 622, and the inner frame 621 is a planar member.

An improved structure for an amplifier comprises: a single member 71, which at least has a frame 711, an edge 712, a membrane 713, a voice coil 715, and an anti-dust cover 714; and a positioning shrapnel 72, which is assembled by an outer frame 722 and a plurality of flexible braces 723, the outer frame 722 is firmly disposed at the frame 711 of the single member 71, the one end of each of the plurality of flexible braces 723 is connected with the outer frame 722, the other end of each of the plurality of flexible braces 723 is firmly disposed on the anti-dust cover 714, wherein the one end of each of the plurality of flexible braces 723 is connected with the outer frame 722, the other end of each of the plurality of flexible braces 723 is a holding portion 7232 that is firmly disposed on the anti-dust cover 714, the peripheral of the frame 711 has a fillister 7111 that can be embedded in by the outer frame 722, each of the flexible braces 723 has a curve portion 7231 that is to keep the connection of the holding portion 7232 and the outer frame 722 while a height difference is existed between the holding portion 7232 and the outer frame 722, and any of the flexible braces 723 is curved and disposed.

Other and further features, advantages, and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Following preferred embodiments and figures will be described in detail so as to achieve aforesaid objects.

Figure 1A:
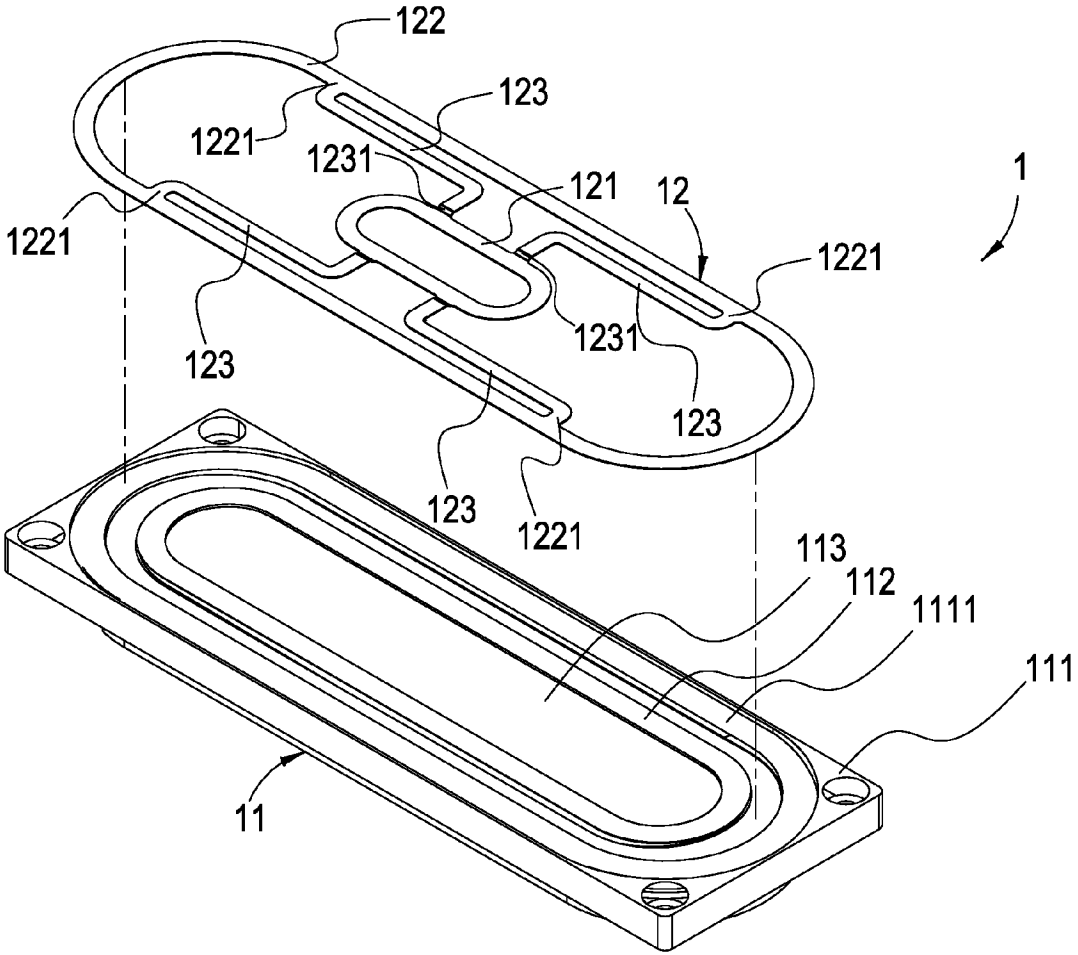
FIG. 1A illustrates a 3-D exploded view of a first preferred embodiment of an improved structure for an amplifier of the present invention.
Figure 1B:
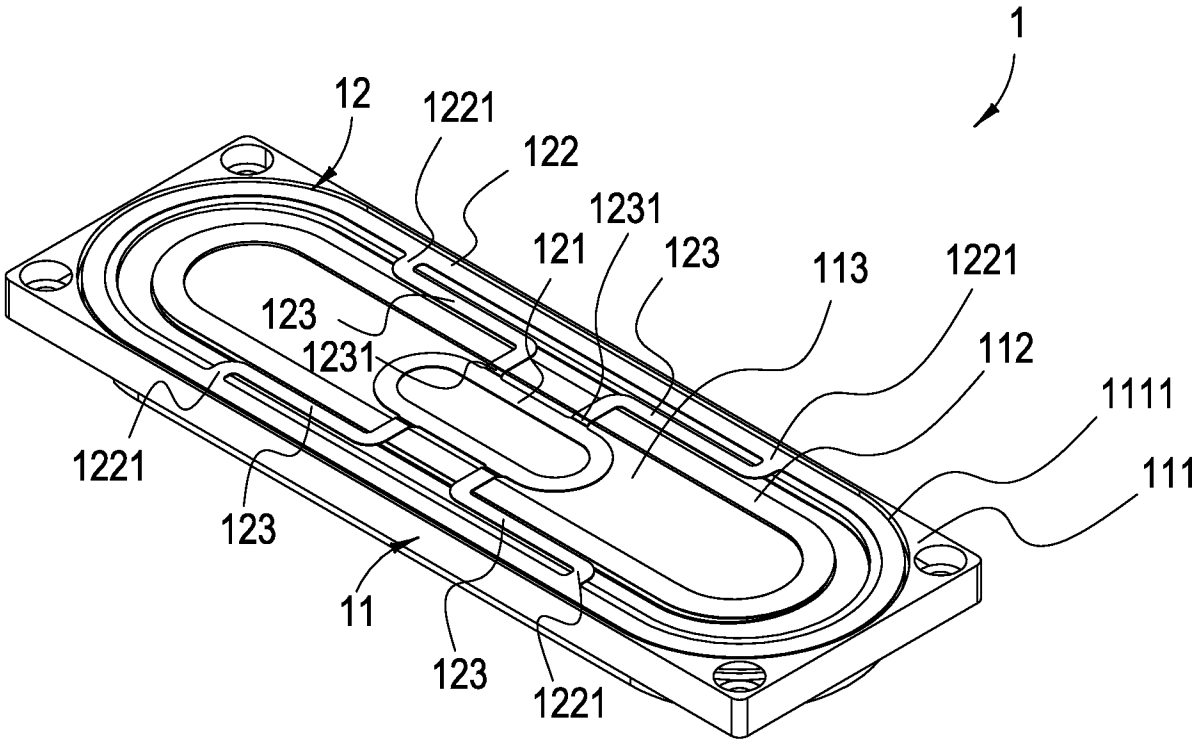
FIG. 1B illustrates a 3-D view of the first preferred embodiment of the improved structure for the amplifier of the present invention.

With references to FIG. 1A and FIG. 1B, which illustrate a 3-D exploded view of a first preferred embodiment of an improved structure for an amplifier of the present invention and a 3-D view of the first preferred embodiment of the improved structure for the amplifier of the present invention. As shown in figures, the improved structure 1 for the amplifier includes: a rectangular single member 11, at least having a frame 111, an edge 112 and a membrane 113, wherein the peripheral of the frame 111 has a fillister 1111 that can be embedded in by the outer frame 122; and a positioning shrapnel 12, which is assembled by an inner frame 121, an outer frame 122 and four flexible braces 123, the outer frame 122 is firmly disposed at the fillister 1111 of the single member 11, the flexible braces 123 are disposed between the inner frame 121 and the outer frame 122, the inner frame 121 is firmly disposed on the membrane 113 of the single member 11; each connection of any of the flexible braces 123 and the inner frame 121 is a curve portion 1231 that is to keep the connection of the inner frame 121 and the outer frame 122 while a height difference (the inner frame is lower than the outer frame in figures) is existed between the inner frame 121 and the outer frame 122; otherwise, the curve portion shall be designed reversely.

The improved structure 1 for the amplifier has a single member 11 and a positioning shrapnel 12, wherein the positioning shrapnel 12 is firmly disposed on the sound-emitting surface of the single member 11. A balance state is made through four connecting points 1221 of the outer frame 122 of the positioning shrapnel 12 and the inner frame 121 firmly disposed on the membrane 113. Therefore, while the rectangular single member 11 is in vibration to synchronize the membrane 113, the membrane 113 in vibration can be effectively controlled under a balance state through the positioning shrapnel 12 so as to avoid the unbalanced vibration from the membrane 113 and a situation of unstable frequencies when the improved structure 1 is in a condition of high power.

Figure 2A:
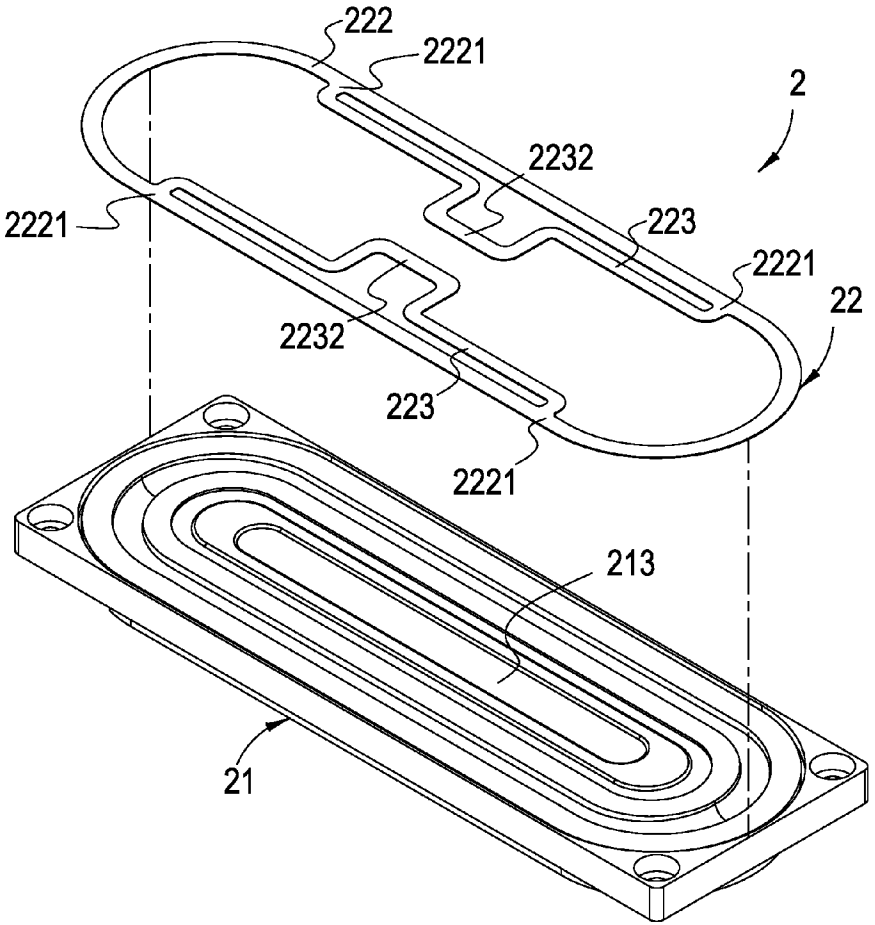
FIG. 2A illustrates a 3-D exploded view of a second preferred embodiment of the improved structure for the amplifier of the present invention.
Figure 2B:
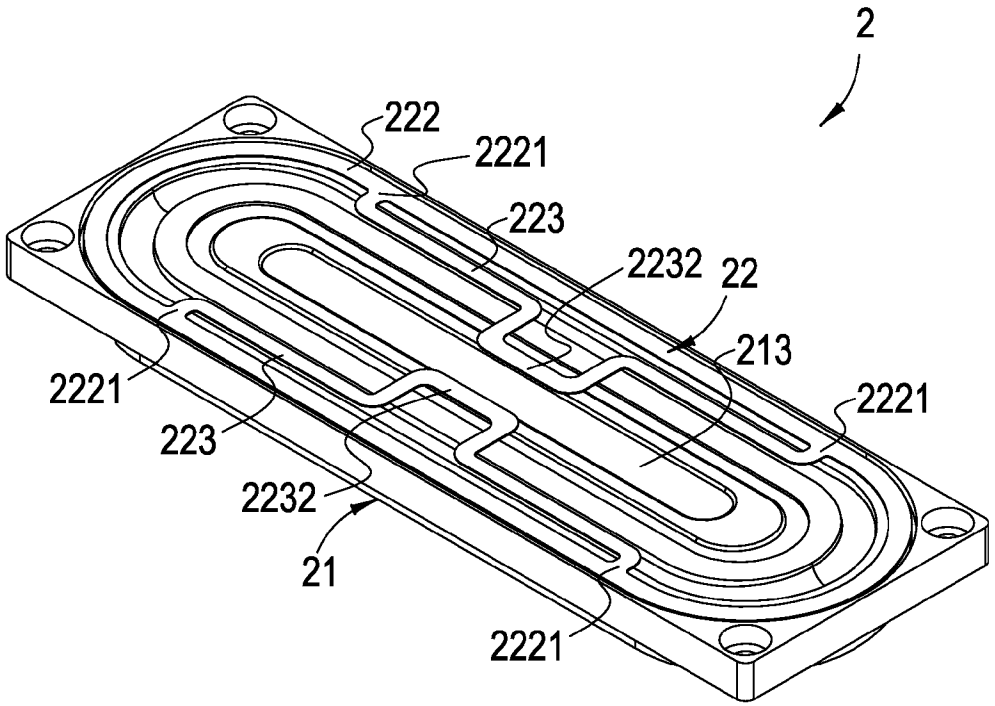
FIG. 2B illustrates a 3-D view of the second preferred embodiment of the improved structure for the amplifier of the present invention.

With references to FIG. 2A and FIG. 2B, which illustrate a 3-D exploded view of a second preferred embodiment of the improved structure for the amplifier of the present invention and a 3-D view of the second preferred embodiment of the improved structure for the amplifier of the present invention. As shown in figures, the difference between the second preferred embodiment and the first preferred embodiment is a positioning shrapnel 22 cooperated with a rectangular single member 21. The positioning shrapnel 22 is assembled by an outer frame 222 and two flexible braces 223, each of the plurality of flexible braces 223 is a holding portion 2232, two ends of each of the flexible braces 223 are connected with the one side of the outer frame 222, the two flexible braces 223 are formed as two corresponding holding portions 2232 that are firmly disposed on a membrane 213. A balance state is made through four connecting points 2221 of the outer frame 222 and the two corresponding holding portions 2232. Therefore, while the rectangular single member 21 is in vibration to synchronize the membrane 213, the membrane 213 in vibration can be effectively controlled under a balance state by the positioning shrapnel 22.

Figure 3A:
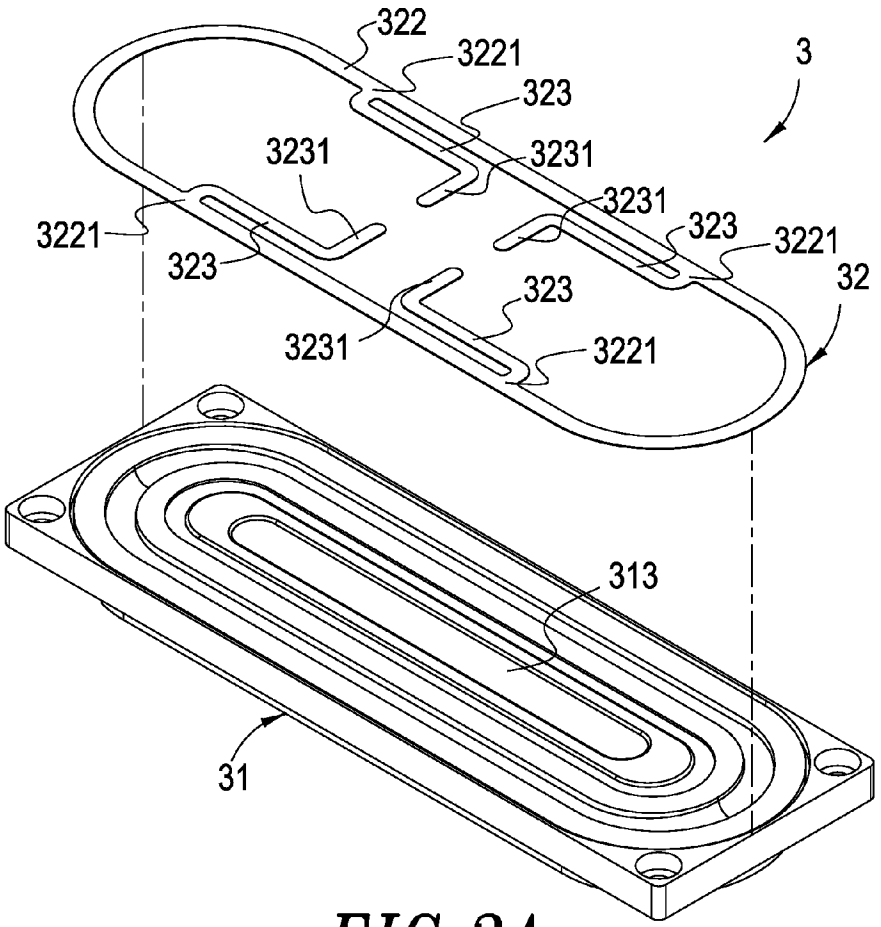
FIG. 3A illustrates a 3-D exploded view of a third preferred embodiment of the improved structure for the amplifier of the present invention.
Figure 3B:
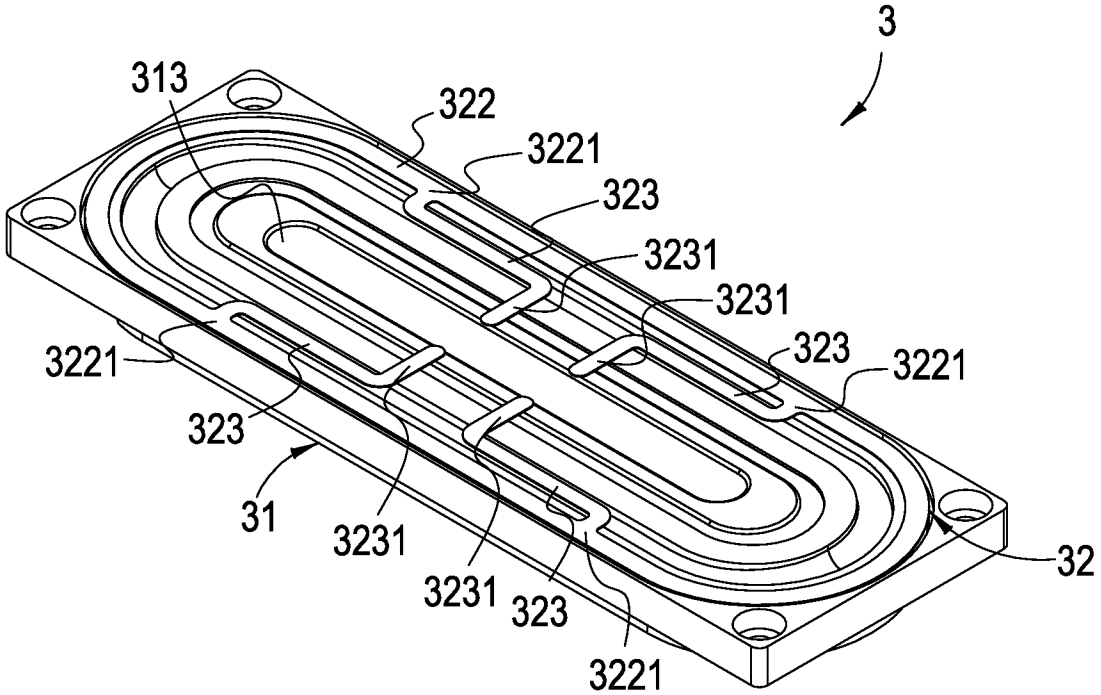
FIG. 3B illustrates a 3-D view of the third preferred embodiment of the improved structure for the amplifier of the present invention.

With references to FIG. 3A and FIG. 3B, which illustrate a 3-D exploded view of a third preferred embodiment of the improved structure for the amplifier of the present invention and a 3-D view of the third preferred embodiment of the improved structure for the amplifier of the present invention. As shown in figures, the difference between the third preferred embodiment and the first preferred embodiment is a positioning shrapnel 32 cooperated with a rectangular single member 31. The positioning shrapnel 32 is assembled by an outer frame 322 and four flexible braces 323, the one end of each of the plurality of flexible braces 323 is connected with the outer frame 322, the other end 3231 of each of the plurality of flexible braces 323 is firmly disposed on a membrane 313. A balance state is made through four connecting points 3221 of the outer frame 322 and the ends 3231. Therefore, while the rectangular single member 31 is in vibration to synchronize the membrane 313, the membrane 313 in vibration can be effectively controlled under a balance state by the positioning shrapnel 32.

Figure 4A:
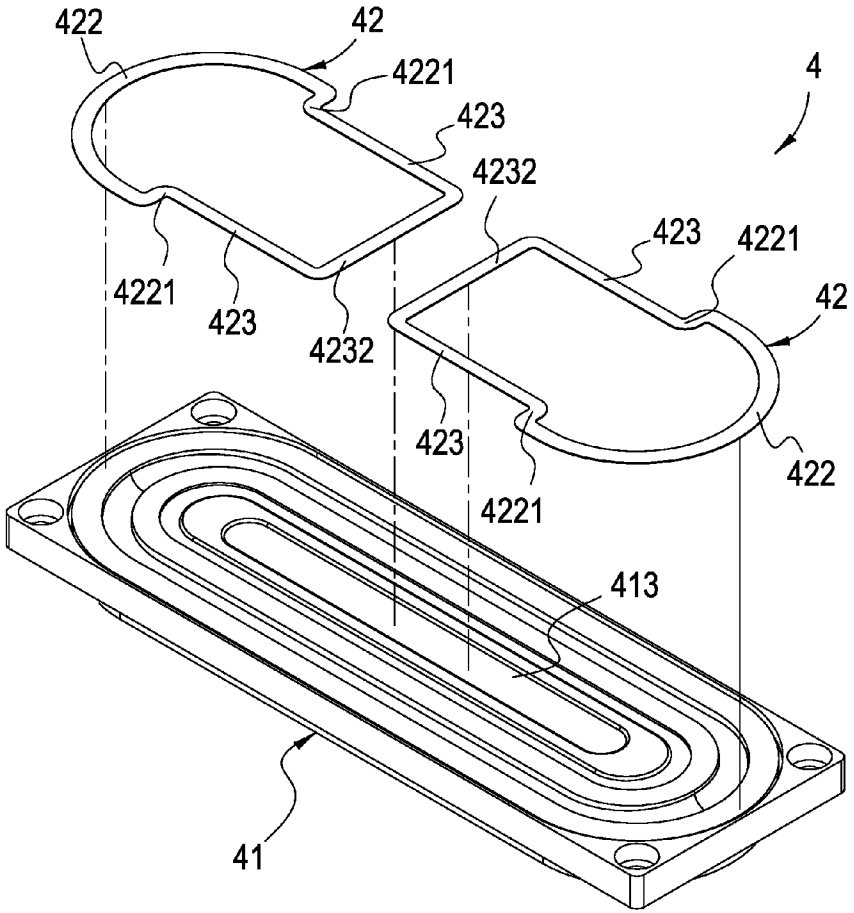
FIG. 4A illustrates a 3-D exploded view of a fourth preferred embodiment of the improved structure for the amplifier of the present invention.
Figure 4B:
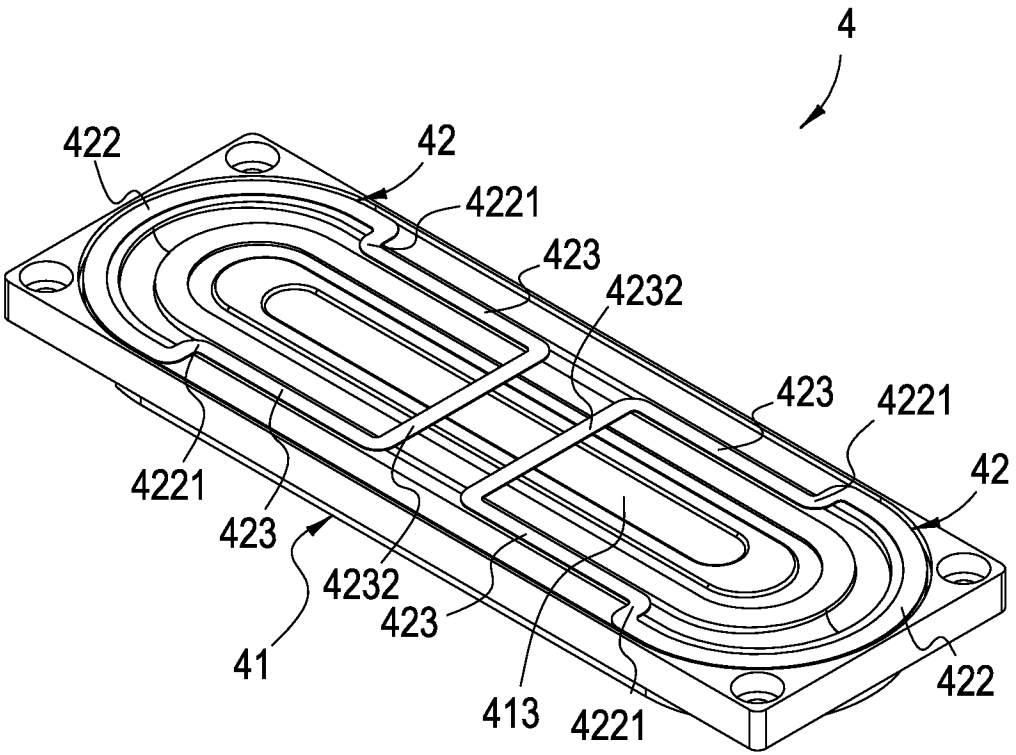
FIG. 4B illustrates a 3-D view of the fourth preferred embodiment of the improved structure for the amplifier of the present invention.

With references to FIG. 4A and FIG. 4B, which illustrate a 3-D exploded view of a fourth preferred embodiment of the improved structure for the amplifier of the present invention and a 3-D view of the fourth preferred embodiment of the improved structure for the amplifier of the present invention. As shown in figures, the difference between the fourth preferred embodiment and the first preferred embodiment is a positioning shrapnel 42 cooperated with a rectangular single member 41. For the fourth preferred embodiment, there are two positioning shrapnels 42. The positioning shrapnel 42 is assembled by an outer frame 422 and two flexible braces 423 that are extended from the outer frame 42 individually. The two ends of the two flexible braces 423 are formed two corresponding holding portions 4232 that are firmly disposed on a membrane 413. A balance state is made through four connecting points 4221 of the outer frame 422 and the two corresponding holding portions 4232. Therefore, while the rectangular single member 41 is in vibration to synchronize the membrane 413, the membrane 413 in vibration can be effectively controlled under a balance state by the positioning shrapnels 42.

For the second, third and fourth preferred embodiments, each of the flexible braces of the preferred embodiments may be the same as the first preferred embodiment to have the curve portion that is to keep the connection of the inner frame and the outer frame while a height difference is existed between the inner frame and the outer frame.

Figure 5A:
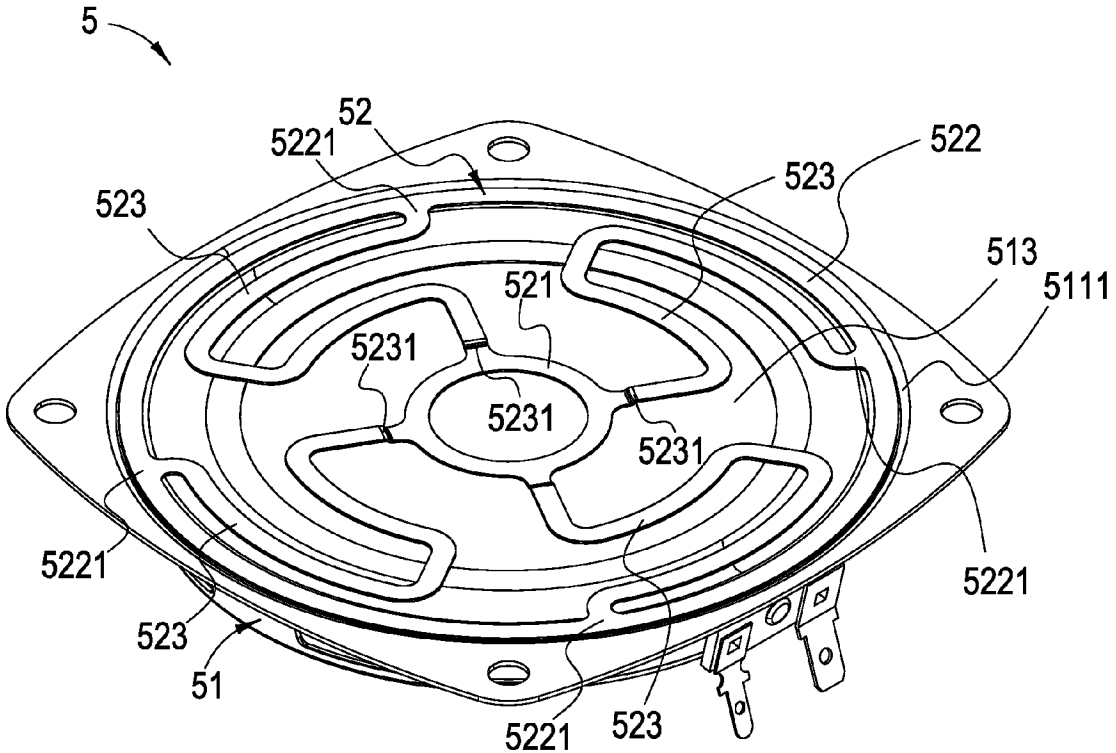
FIG. 5A illustrates a 3-D view of a fifth preferred embodiment of the improved structure for the amplifier of the present invention.

With references to FIG. 5A, which illustrates a 3-D view of a fifth preferred embodiment of the improved structure for the amplifier of the present invention. As shown in figure, the differences between the fifth preferred embodiment and the first preferred embodiment are of a round single member 51 replacing the rectangular single member and a positioning shrapnel 52 cooperated with the round single member 51, but the theory of the fifth preferred embodiment is the same as the first preferred embodiment. The positioning shrapnel 52 is assembled by an inner frame 521, an outer frame 522 and four flexible braces 523, the outer frame 522 is firmly disposed at the fillister 5111 of the round single member 51, the flexible braces 523 are curved and disposed between the inner frame 521 and the outer frame 522, the inner frame 521 is firmly disposed on a membrane 513 of the round single member 51; each connection of any of the flexible braces 523 and the inner frame 521 is a curve portion 5231 that is to keep the connection of the inner frame 521 and the outer frame 522 while a height difference (the inner frame is lower than the outer frame in figure) is existed between the inner frame 521 and the outer frame 522; otherwise, the curve portion shall be designed reversely.

The improved structure 5 for the amplifier has a round single member 51 and a positioning shrapnel 52, wherein the positioning shrapnel 52 is firmly disposed on the sound-emitting surface of the round single member 51. A balance state is made through four connecting points 5221 of the outer frame 522 of the positioning shrapnel 52 and the inner frame 521 firmly disposed on the membrane 513. Therefore, while the round single member 51 is in vibration to synchronize the membrane 513, the membrane 513 in vibration can be effectively controlled under a balance state through the positioning shrapnel 52 so as to avoid the unbalanced vibration from the membrane 513 and a situation of unstable frequencies when the improved structure 5 is in a condition of high power.

Figure 5B:
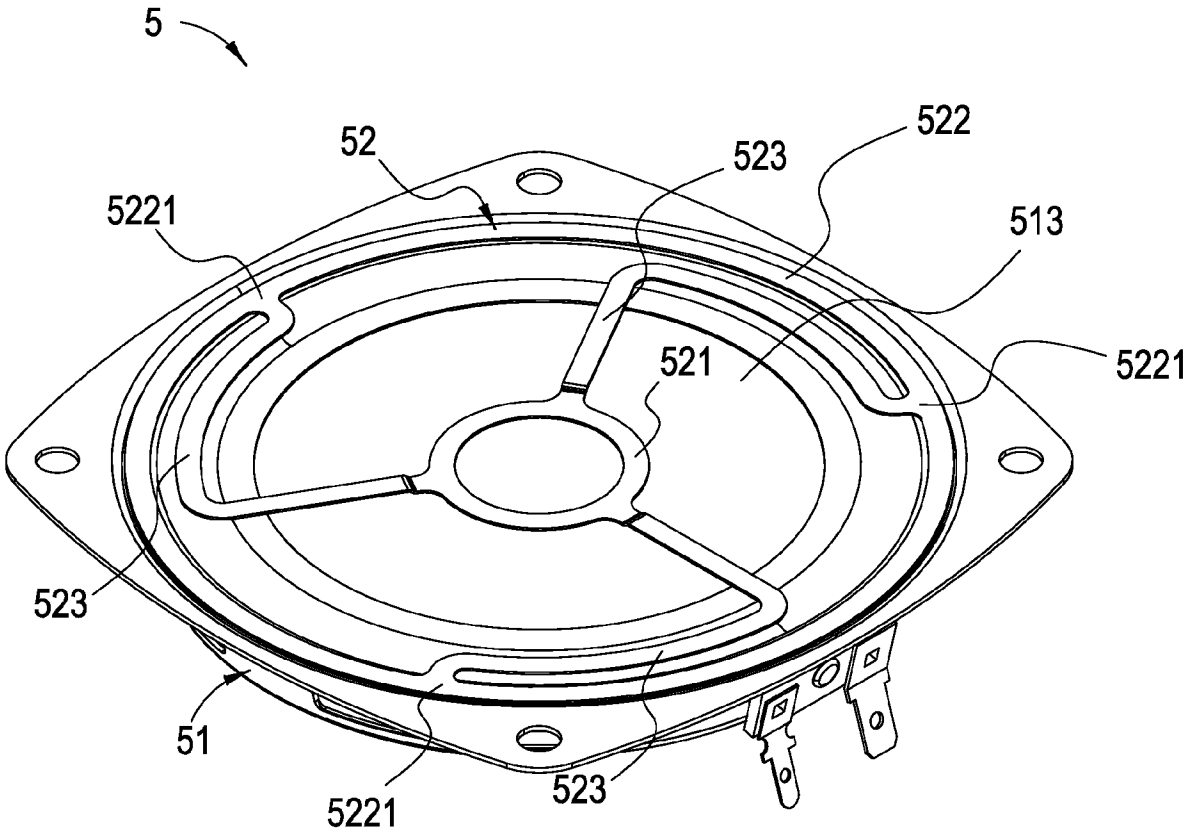
FIG. 5B illustrates a 3-D view of a sixth preferred embodiment of the improved structure for the amplifier of the present invention.

With references to FIG. 5B, which illustrates a 3-D view of a sixth preferred embodiment of the improved structure for the amplifier of the present invention. As shown in figures, the difference between the sixth preferred embodiment and the fifth preferred embodiment is the positioning shrapnel 52 cooperated with the round single member 51. The positioning shrapnel 52 is assembled by the inner frame 521, the outer frame 522 and the three flexible braces 523 and firmly disposed on the sound-emitting surface of the round single member 51. A balance state is made through three connecting points 5221 of the outer frame 522 of the positioning shrapnel 52 and the inner frame 521 firmly disposed on the membrane 513. Therefore, while the single member 51 is in vibration to synchronize the membrane 513, the membrane 513 in vibration can be effectively controlled under a balance state by the positioning shrapnel 52.

Figure 5C:
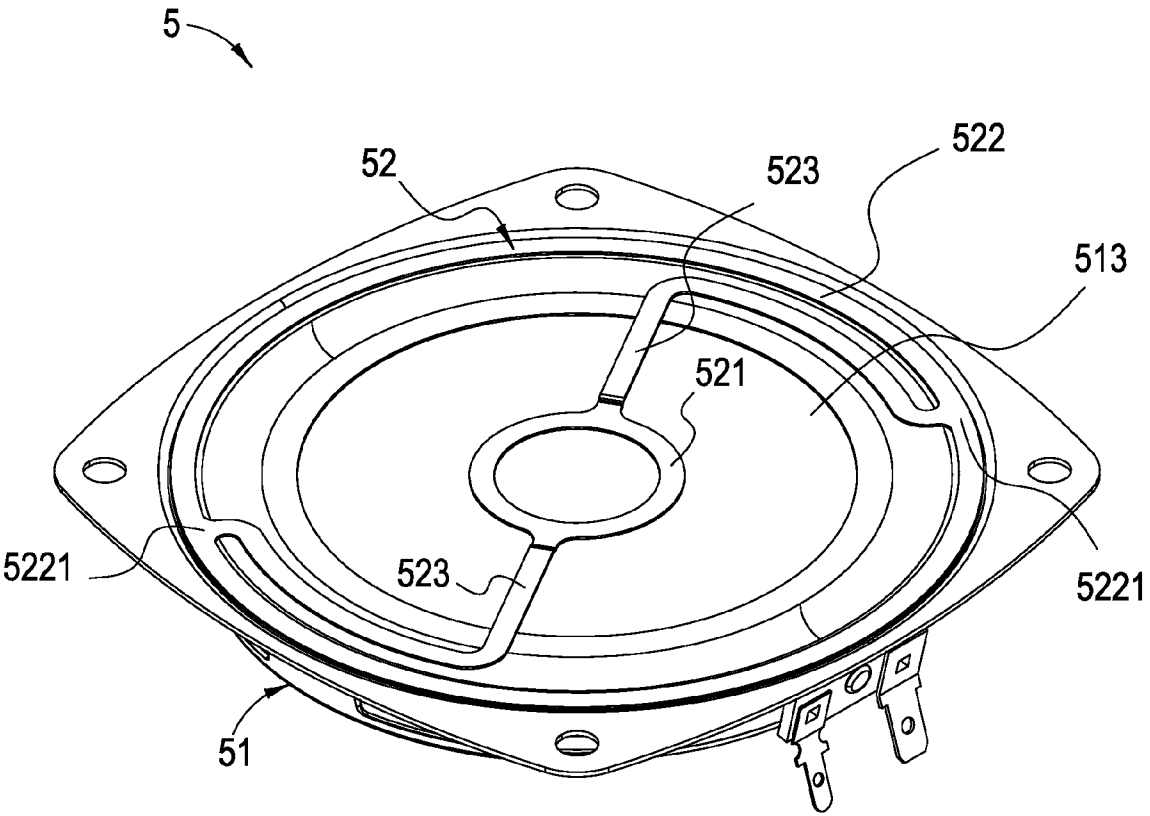
FIG. 5C illustrates a 3-D view of a seventh preferred embodiment of the improved structure for the amplifier of the present invention

With references to FIG. 5C, which illustrates a 3-D view of a seventh preferred embodiment of the improved structure for the amplifier of the present invention. As shown in figures, the difference between the seventh preferred embodiment and the fifth preferred embodiment is the positioning shrapnel 52 cooperated with the round single member 51. The positioning shrapnel 52 is assembled by the inner frame 521, the outer frame 522 and the two flexible braces 523 and firmly disposed on the sound-emitting surface of the round single member 51. A balance state is made through two connecting points 5221 of the outer frame 522 of the positioning shrapnel 52 and the inner frame 521 firmly disposed on the membrane 513. Therefore, while the single member 51 is in vibration to synchronize the membrane 513, the membrane 513 in vibration can be effectively controlled under a balance state by the positioning shrapnel 52.

Figure 6A:
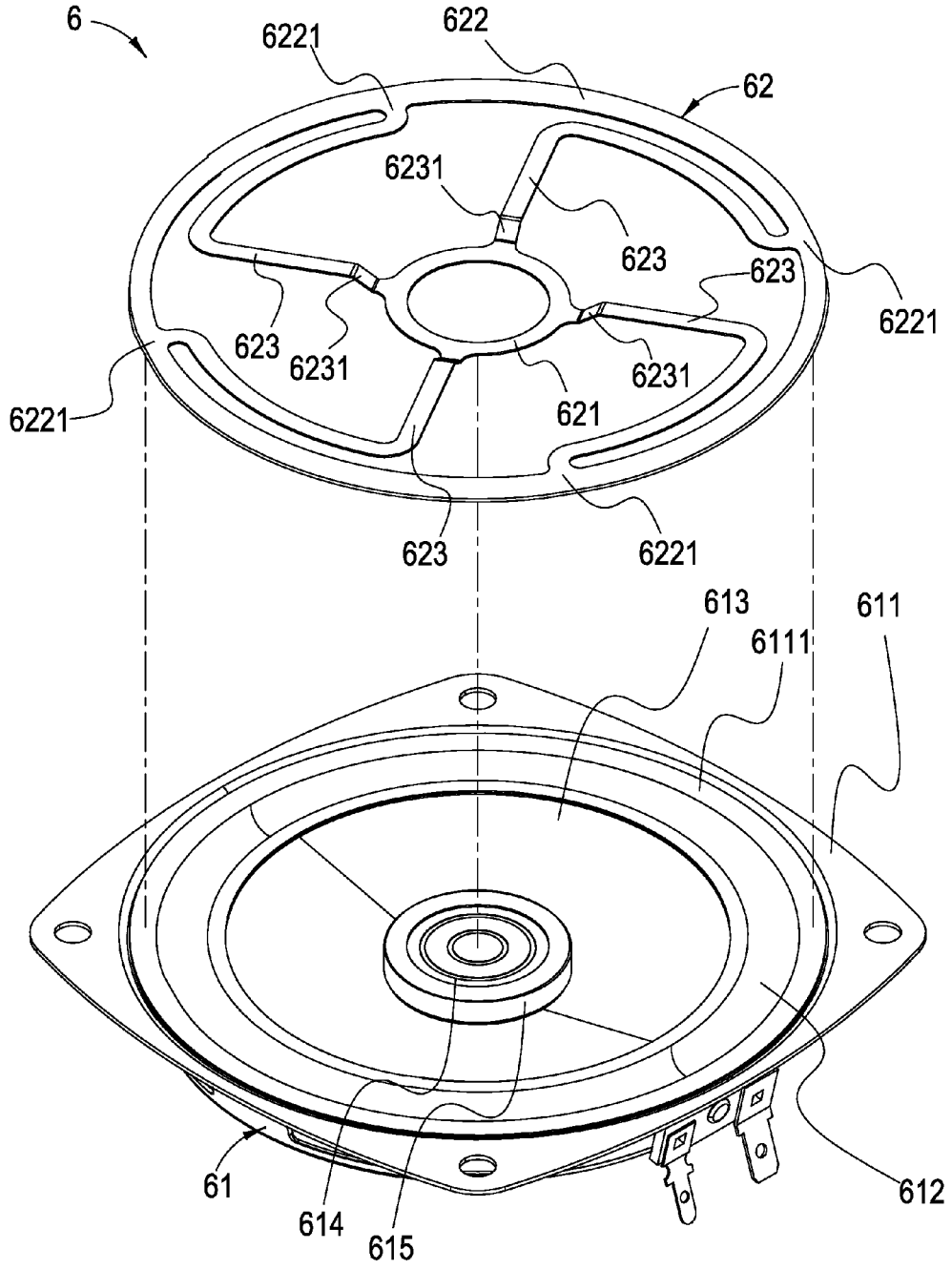
FIG. 6A illustrates a 3-D exploded view of an eighth preferred embodiment of the improved structure for the amplifier of the present invention.
Figure 6B:
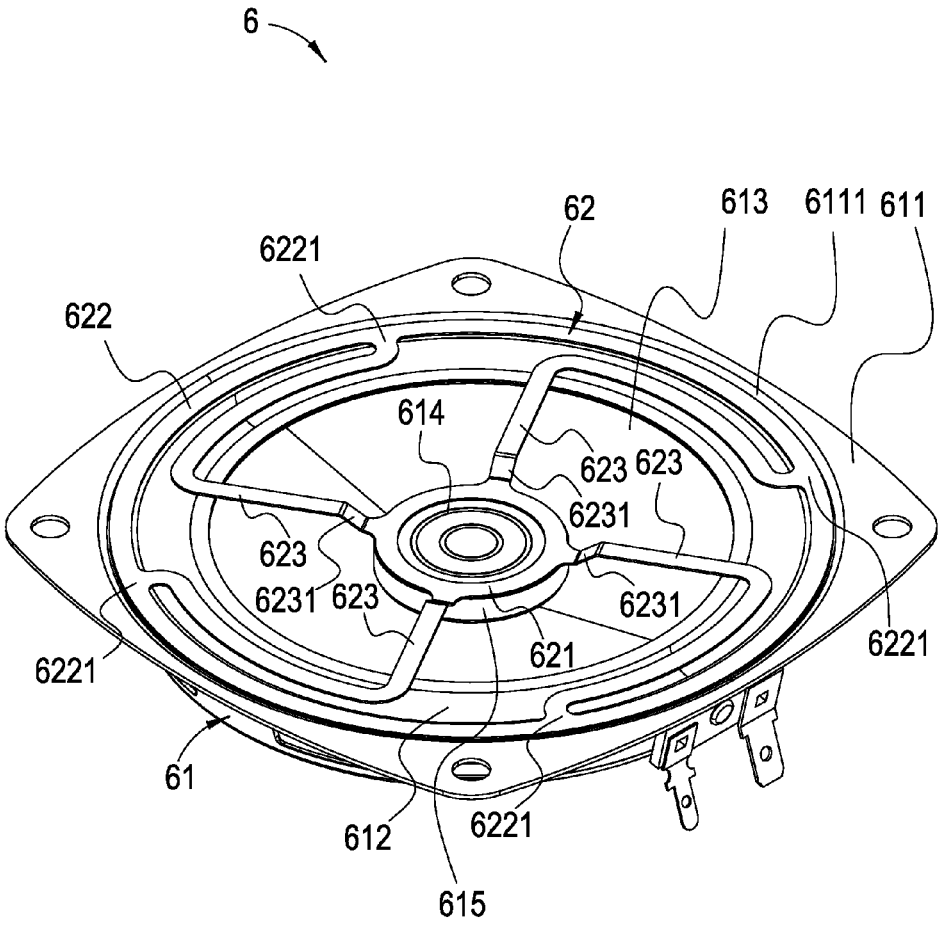
FIG. 6B illustrates a 3-D view of the eighth preferred embodiment of the improved structure for the amplifier of the present invention.

With references to FIG. 6A and FIG. 6B, which illustrate a 3-D exploded view of an eighth preferred embodiment of the improved structure for the amplifier of the present invention and a 3-D view of the eighth preferred embodiment of the improved structure for the amplifier of the present invention. As shown in figures, the improved structure 6 for the amplifier includes: a round single member 61, which at least has a frame 611, an edge 612, a membrane 613, a voice coil 615, and an anti-dust cover 614, wherein the peripheral of the frame 611 has a fillister 6111 that can be embedded in by the outer frame 622; and a positioning shrapnel 62, which is assembled by an inner frame 621, an outer frame 622 and four flexible braces 623, the outer frame 622 is firmly disposed in the fillister 6111 of the single member 61, the flexible braces 623 are curved and disposed between the inner frame 621 and the outer frame 622, the inner frame 621 being firmly disposed on the peripheral of the anti-dust cover 614 of the single member 61; each connection of any of the flexible braces 623 and the inner frame 621 is a curve portion 6231 that is to keep the connection of the inner frame 621 and the outer frame 622 while a height difference (the inner frame is lower than the outer frame in figures) is existed between the inner frame 621 and the outer frame 622; otherwise, the curve portion shall be designed reversely.

The improved structure 6 for the amplifier has a round single member 61 and a positioning shrapnel 62, wherein the positioning shrapnel 62 is firmly disposed on the sound-emitting surface of the round single member 61. A balance state is made through four connecting points 6221 of the outer frame 622 of the positioning shrapnel 62 and the inner frame 621 firmly disposed on the anti-dust cover 614. Therefore, while the round single member 61 is in vibration to synchronize the membrane 613, the membrane 613 in vibration can be effectively controlled under a balance state through the positioning shrapnel 62 so as to avoid the unbalanced vibrations from the membrane 613 and the anti-dust cover 614 and a situation of unstable frequencies when the improved structure 6 is in a condition of high power.

Figure 7A:
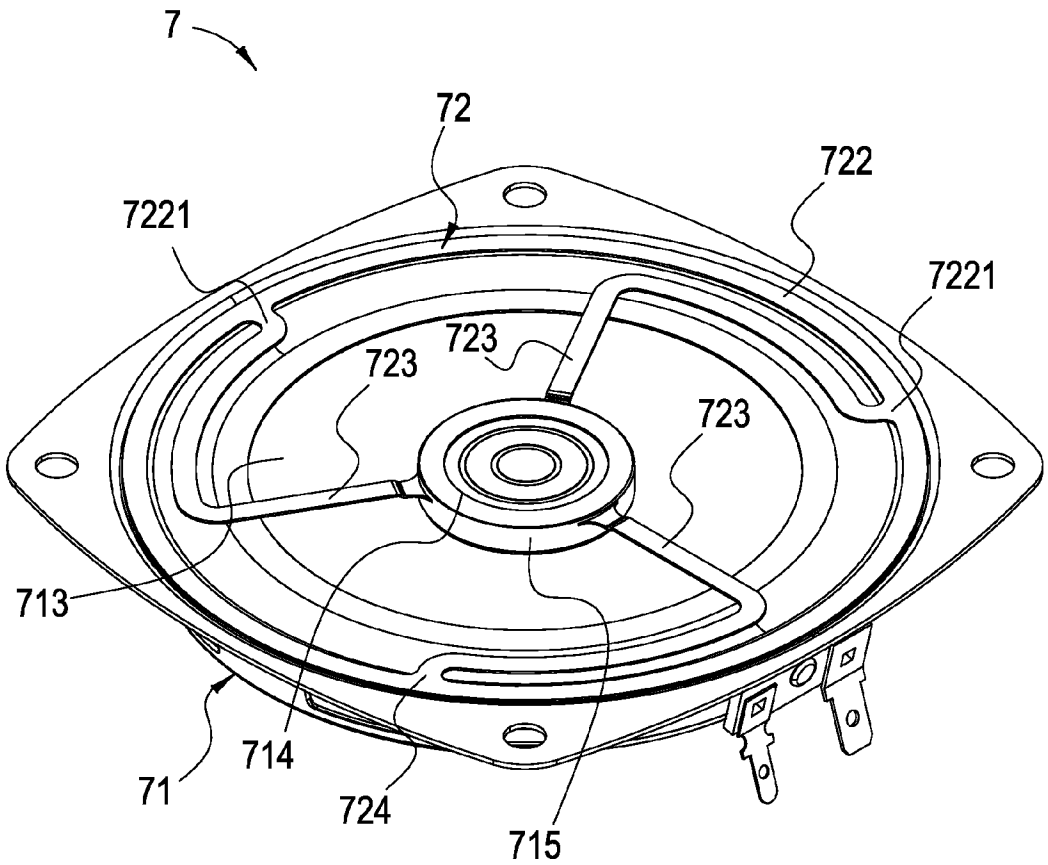
FIG. 7A illustrates a 3-D view of a ninth preferred embodiment of the improved structure for the amplifier of the present invention.

With references to FIG. 7A, which illustrates a 3-D view of a ninth preferred embodiment of the improved structure for the amplifier of the present invention. As shown in figure, the difference between the ninth preferred embodiment and the eighth preferred embodiment is of the improved structure 7 only having three flexible braces 723. Each of the flexible braces 723 is curved and disposed between an inner frame (not shown in figure) and an outer frame 722. The inner frame is firmly disposed between a voice coil 715 and an anti-dust cover 714. A balance state is made through two connecting points 6221 of the outer frame 722 of the positioning shrapnel 72 and the inner frame firmly disposed between the voice coil 715 the anti-dust cover 714. Therefore, while the round single member 71 is in vibration to synchronize the membrane 713, the membrane 713 in vibration can be effectively controlled under a balance state through the positioning shrapnel 72.

Figure 7B:
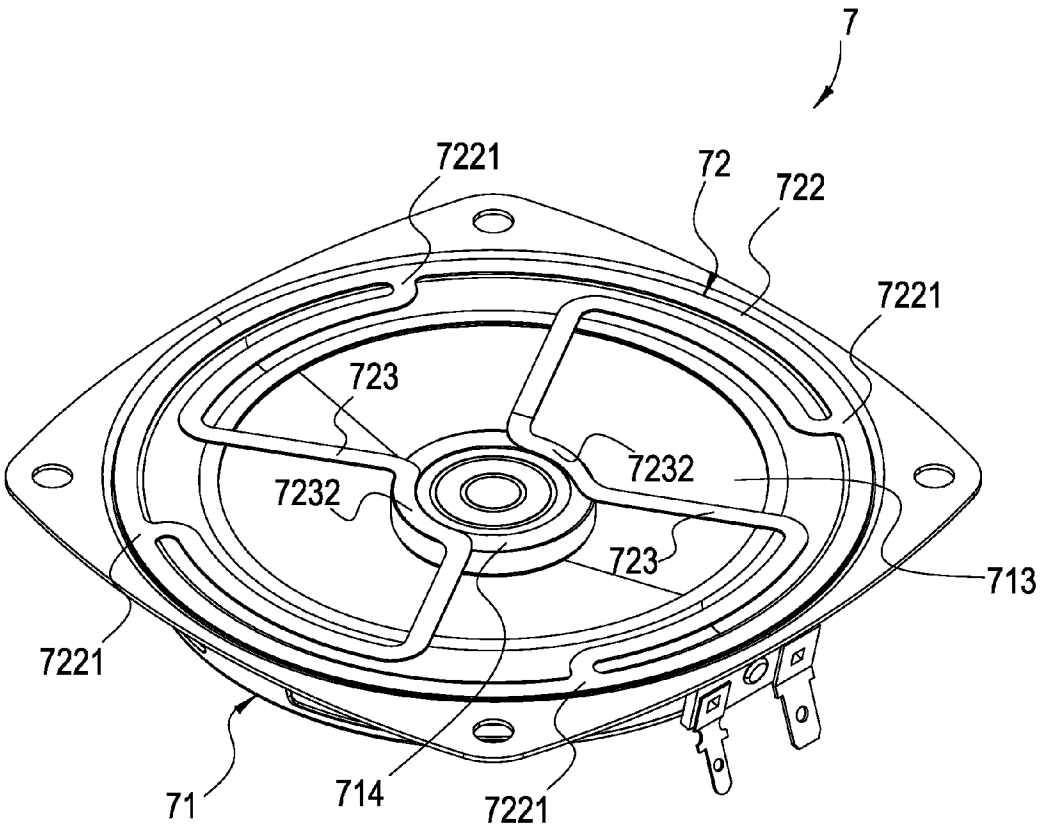
FIG. 7B illustrates a 3-D view of a tenth preferred embodiment of the improved structure for the amplifier of the present invention.

With references to FIG. 7B, which illustrates a 3-D view of a tenth preferred embodiment of the improved structure for the amplifier of the present invention. As shown in figure, the difference between the tenth preferred embodiment and the eighth preferred embodiment is the positioning shrapnel 72 cooperated with the round single member 71. The positioning shrapnel 72 is assembled by the outer frame 722 and two flexible braces 723. Each of the flexible braces 723 is curved to form a holding portion 7232, two ends of each of the flexible braces 723 are connected with the one side of the outer frame 722, the two flexible braces 723 are formed as two corresponding holding portions 7232 that are firmly disposed on the anti-dust cover 714. A balance state is made through four connecting points 7221 of the outer frame 722 and the two corresponding holding portions 7232. Therefore, while the round single member 71 is in vibration to synchronize the membrane 213, the membrane 213 in vibration can be effectively controlled under a balance state by the positioning shrapnel 72.

Figure 7C:
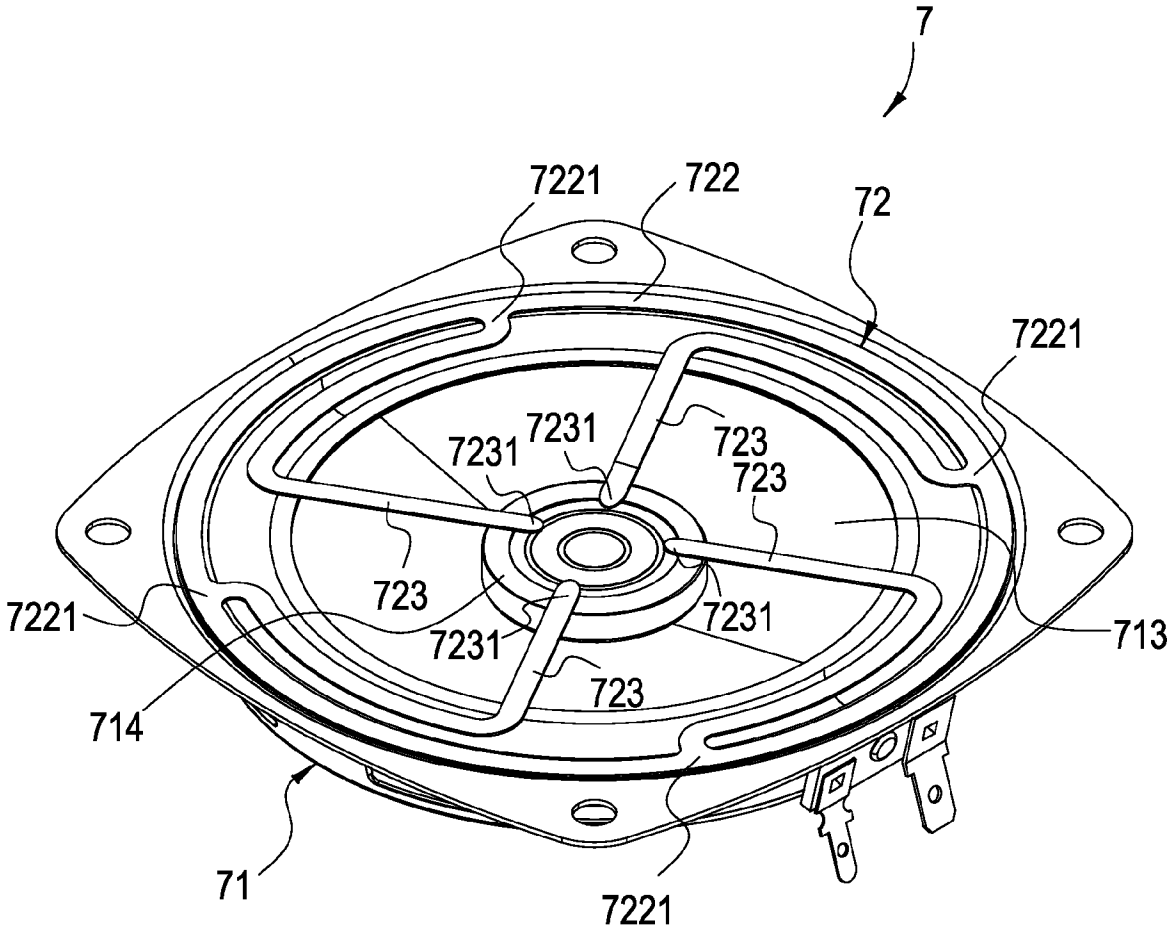
FIG. 7C illustrates a 3-D view of an eleventh preferred embodiment of the improved structure for the amplifier of the present invention.

With references to FIG. 7C, which illustrates a 3-D view of an eleventh preferred embodiment of the improved structure for the amplifier of the present invention. As shown in figure, the difference between the eleventh preferred embodiment and the eighth preferred embodiment is the positioning shrapnel 72 cooperated with the round single member 71. The positioning shrapnel 72 is assembled by the outer frame 722 and four flexible braces 723. The one end of each of the flexible braces 723 is curved to be connected with the outer frame 722, the other end 7231 of each of the flexible braces 723 is firmly disposed on the anti-dust cover 714. A balance state is made through four connecting points 7221 of the outer frame 722 and the four flexible braces 723. Therefore, while the round single member 71 is in vibration to synchronize the membrane 213, the membrane 213 in vibration can be effectively controlled under a balance state by the positioning shrapnel 72.

The flexible braces of FIG. 7A, FIG. 7B and FIG. 7C of the ninth, tenth and eleventh preferred embodiments can be the same as FIG. 6A and FIG. 6B of the eighth preferred embodiment, that is, each flexible brace has a curve portion. The curve portion is to keep the connection of the inner frame and the outer frame while a height difference is existed between the inner frame and the outer frame.

With the comparison to prior arts, the improved structure for the amplifier has following advantages that are listed below:

1. For the present invention, the positioning shrapnel is firmly disposed on the sound-emitting surface of the single member, and positions and balances the vibration state of the membrane, so that the unbalanced vibration from the membrane and a situation of unstable frequencies can be avoided when the improved structure is in a condition of high power.
2. The present invention not only provides a slim volume, but also high power output, hence the amplifier can be versatile in the aspect of application.
3. For the present invention, the positioning shrapnel is suitable to different types of single members of amplifiers, therefore, the formation, quantity and bending angle of the flexible brace can be adjusted in order to approach the best output.

Although the invention has been disclosed and illustrated with reference to particular embodiments, the principles involved are susceptible for use in numerous other embodiments that will be apparent to persons skilled in the art. This invention is, therefore, to be limited only as indicated by the scope of the appended claims

What is claimed is:

1. An improved structure for an amplifier comprising:

a single member, at least having a frame, an edge and a membrane; and a positioning shrapnel, which is assembled by an inner frame, an outer frame and a plurality of flexible braces, the outer frame being firmly disposed at the frame of the single member, the plurality of flexible braces being disposed between the inner frame and the outer frame, the inner frame being firmly disposed on the membrane of the single member; and each connection of any of the flexible braces and the inner frame is a curve portion that is to keep the connection of the inner frame and the outer frame while a height difference is existed between the inner frame and the outer frame.

2. The improved structure for the amplifier according to claim 1, wherein the peripheral of the frame has a fillister that can be embedded in by the outer frame.

3. The improved structure for the amplifier according to claim 1, wherein any of the flexible braces is curved to be disposed between the inner frame and the outer frame.

4. The improved structure for the amplifier according to claim 1, wherein the inner frame is a planar member.

5. An improved structure for an amplifier comprising:

a single member, at least having a frame, an edge and a membrane; and a positioning shrapnel, which is assembled by an outer frame and a plurality of flexible braces, the outer frame being firmly disposed at the frame of the single member, the one end of each of the plurality of flexible braces being connected with the outer frame, the other end of each of the plurality of flexible braces being firmly disposed on the membrane;

the one end of each of the plurality of flexible braces is connected with the outer frame, the other end of each of the plurality of flexible braces being a holding portion that is firmly disposed on the membrane; and each of the flexible braces has a curve portion that is to keep the connection of the holding portion and the outer frame while a height difference is existed between the holding portion and the outer frame.

6. The improved structure for the amplifier according to claim 5, wherein the peripheral of the frame has a fillister that can be embedded in by the outer frame.

7. The improved structure for the amplifier according to claim 5, wherein any of the flexible braces is curved.

8. An improved structure for an amplifier comprising:

a single member, at least having a frame, an edge, a membrane, a voice coil, and an anti-dust cover; and a positioning shrapnel, which is assembled by an inner frame, an outer frame and a plurality of flexible braces, the outer frame being firmly disposed at the frame of the single member, the flexible braces being disposed between the inner frame and the outer frame, the inner frame being firmly disposed on the anti-dust cover of the single member;

the inner frame is firmly disposed between the anti-dust cover and the voice coil of the single member;

each connection of any of the flexible braces and the inner frame is a curve portion that is to keep the connection of the inner frame and the outer frame while a height difference is existed between the inner frame and the outer frame.

9. The improved structure for the amplifier according to claim 8, wherein the peripheral of the frame has a fillister that can be embedded in by the outer frame.

10. The improved structure for the amplifier according to claim 8, wherein any of the flexible braces is curved to be disposed between the inner frame and the outer frame.

11. The improved structure for the amplifier according to claim 8, wherein the inner frame is a planar member.

12. An improved structure for an amplifier comprising:

a single member, at least having a frame, an edge, a membrane, a voice coil, and an anti-dust cover; and a positioning shrapnel, which is assembled by an outer frame and a plurality of flexible braces, the outer frame being firmly disposed at the frame of the single member, the one end of each of the plurality of flexible braces being connected with the outer frame, the other end of each of the plurality of flexible braces being firmly disposed on the anti-dust cover;

the one end of each of the plurality of flexible braces is connected with the outer frame, the other end of each of the plurality of flexible braces being a holding portion that is firmly disposed on the anti-dust cover;

each of the flexible braces has a curve portion that is to keep the connection of the holding portion and the outer frame while a height difference is existed between the holding portion and the outer frame;

the peripheral of the frame has a fillister that can be embedded in by the outer frame;

each of the flexible braces has a curve portion that is to keep the connection of the holding portion and the outer frame while a height difference is existed between the holding portion and the outer frame.

13. The improved structure for the amplifier according to claim 12, wherein any of the flexible braces is curved and disposed.

* * * * *